United States Patent [19]

Byrd

[11] 4,353,236

[45] Oct. 12, 1982

[54] MACHINE FOR FLATTENING THE INTERNAL BEAD OF WELDED TUBING

[76] Inventor: Philip G. Byrd, 638 Rivermoor Dr., Waterford, Wis. 53185

[21] Appl. No.: 212,516

[22] Filed: Dec. 3, 1980

[51] Int. Cl.[3] ..... B21C 37/30

[52] U.S. Cl. ..... 72/193; 72/370; 228/125

[58] Field of Search ..... 72/193, 370; 228/125

[56] References Cited

U.S. PATENT DOCUMENTS 2,600,254 6/1952 Lysobey ..... 72/193

3,877,283 4/1975 Hohl et al. ..... 72/193

FOREIGN PATENT DOCUMENTS 2950299 6/1980 Fed. Rep. of Germany ..... 228/125

*Primary Examiner*—Lowell A. Larson

*Attorney, Agent, or Firm*—Quarles & Brady

[57] ABSTRACT

A machine for removing the internal bead of longitudinal seam welded tubing by flattening includes a mandrel to be positioned within the tubing, an external hammer which includes a vertically oscillating roller which hammers the outside of the tubing opposite the weld so as to force the mandrel against the bead to flatten it and a second roller which serves as an anvil to restrain and shape the external surface of the tube including the weld to prevent the tubing from being deformed.

5 Claims, 3 Drawing Figures

MACHINE FOR FLATTENING THE INTERNAL BEAD OF WELDED TUBING

The present invention relates generally to the longitudinal seam welding of small diameter tubing, especially stainless steel tubing. More particularly, it relates to an apparatus or machine for removing by flattening the internal and external bead which is formed by the longitudinal seam welding of the tubing.

BACKGROUND OF THE INVENTION

In the past, numerous attempts have been made to develop machines for effectively and economically removing the internal bead which is formed by the longitudinal seam welding of tubing.

In the Siegerist U.S. Pat. No. 2,712,249 an apparatus is disclosed which employs a pair of reciprocating hammers and an anvil positioned inside the tubing which cooperate to hammer the bead flat. The anvil is attached to a resilient cable which permits it to move a short distance along with the tubing as it travels and then to be returned to the proper position between the hammers. As a result, the anvil is properly positioned for each successive hammering blow.

In the C. D. Preusch U.S. Pat. No. 3,494,165, an apparatus is disclosed in which a plug of rigid construction is located axially within tubing in contact with the internal surface of the tubing including the bead. The apparatus includes an eccentrically mounted rotating roller which cooperates with a fixed roller to sequentially apply a compressive force at high frequency and with controlled severity to an external surface of the tubing adjacent the plug. The force moves the plug axially within the pipe a short distance and the plug is then released. The Preusch patent states that the maximum severity of the compressive force or squeezing action must be controlled to prevent the failure of the bearings for the eccentrically mounted roller shaft or the cracking of the product at the weld. It also states that the problem presented due to the variability of the force applied by the squeezing action is complicated by variations in the wall thickness of the tubing being formed, as well as, variations in the height of the weld bead. The internal weld bead in the tubing is removed by axial reciprocation of the plug of the Preusch apparatus.

The present invention relates to a machine in which the weld bead is removed by flattening or blending the bead by hammering it with an external hammer and a mandrel located within the tubing.

BRIEF SUMMARY OF THE INVENTION

It is the primary object of the present invention to disclose a novel and effective machine for economically removing by flattening the internal and external bead formed by the longitudinal seam welding of tubing.

It is the further object of the present invention to disclose a machine for flattening the internal and external bead of longitudinal seam welded tubing which includes a mandrel located within the tubing, an external hammer which includes a roller that oscillates vertically to strike the outside of the tubing opposite the weld and an anvil which shapes the outside of the weld.

It is the still further object of the present invention to disclose a machine for flattening the bead of longitudinal seam welded tubing which machine can be incorporated in a welding line so that the tubing as it leaves the welding line is finished and requires no further heating or shaping.

The present invention relates to a bead flattening machine for use in combination with a welding line for making longitudinal seam welded tubing which bead flattening machine includes a mandrel adapted to be resiliently positioned within the tubing, external hammer means for hammering the outside surface of the tubing opposite the weld so as to drive the mandrel into the internal bead to flatten it and anvil means opposed to the hammer means for and shaping the external portion of the weld of the tubing.

In the preferred embodiment of the invention, the external hammer means is a vertically oscillating roller with a tubing receiving groove. The shaft of the roller is attached to a pivotably mounted triangular yoke which is connected in turn to a connecting rod which is driven by an eccentric shaft to impart the oscillating vertical movement to the roller so that the roller strikes the external surface of the tubing opposite the weld successive blows which force the mandrel to strike and flatten the internal bead. The anvil means for shaping the external portion of the weld is a second roller mounted on a vertically fixed shaft. The second roller has a tube receiving groove which flattens any external weld bead which may be present and prevents the weld from being deformed. The oscillating roller and second roller are both mounted on a support stand and the mandrel is preferably mounted on a rod in such a manner that it can move axially in the tubing but it will always return to its operative position to receive hammer blows.

These and other objects of the invention will be apparent to those skilled in the art from the description that follows and the drawing.

BRIEF DESCRIPTION OF PREFERRED EMBODIMENT

Figure 1:
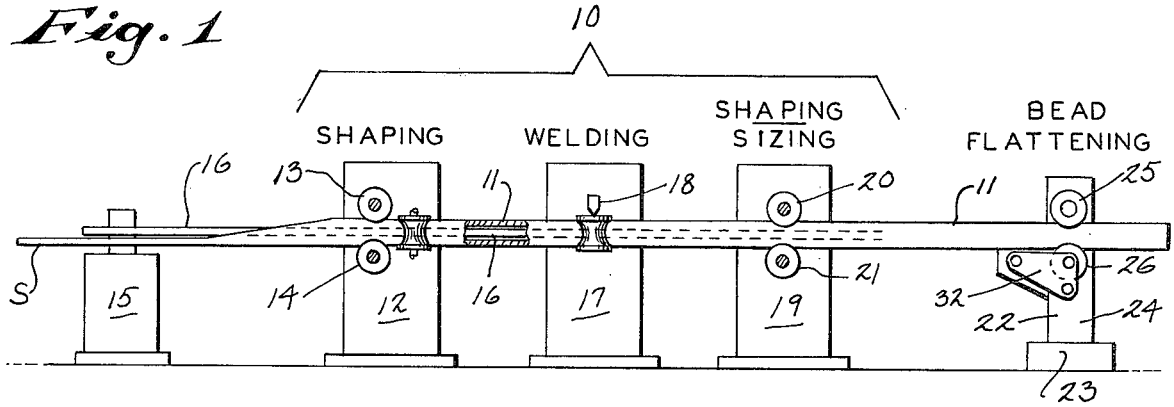
FIG. 1 is an elevational view, partly diagrammatic and partly in section, of a pipe welding line including the bead flattening machine of the present invention.

In FIG. 1 of the drawing, there is schematically shown a welding line 10 whereby skelp S is shaped to form round, longitudinally seam welded tubing 11 by known and conventional procedures. The welding line 10 shown is for illustrative purposes only and is not intended to be complete.

As shown in FIG. 1, the skelp S is partly shaped in one or more shaping stands 12 having rolls 13 and 14. At a point in the welding line 10 at which the tubing 11 is not yet completely formed, there is an upright support 15 to which is anchored one end of a rod 16. The other end of the rod 16 extends into the tubing 11. When the skelp S has been rounded and closed to form the tubing 11 by the operation of one or more shaping stands 12, the tubing 11 moves to a welding station 17 where it is longitudinally seam welded by an electrode 18. The tubing 11 as it leaves the welding station 17 may be further shaped to roundness at a subsequent shaping/-sizing stand 19 having rollers 20 and 21. The tubing 11 then moves on to the bead flattening machine 22 where the internal bead formed by longitudinal seam welding is flattened in the manner to be described.

Figure 2:
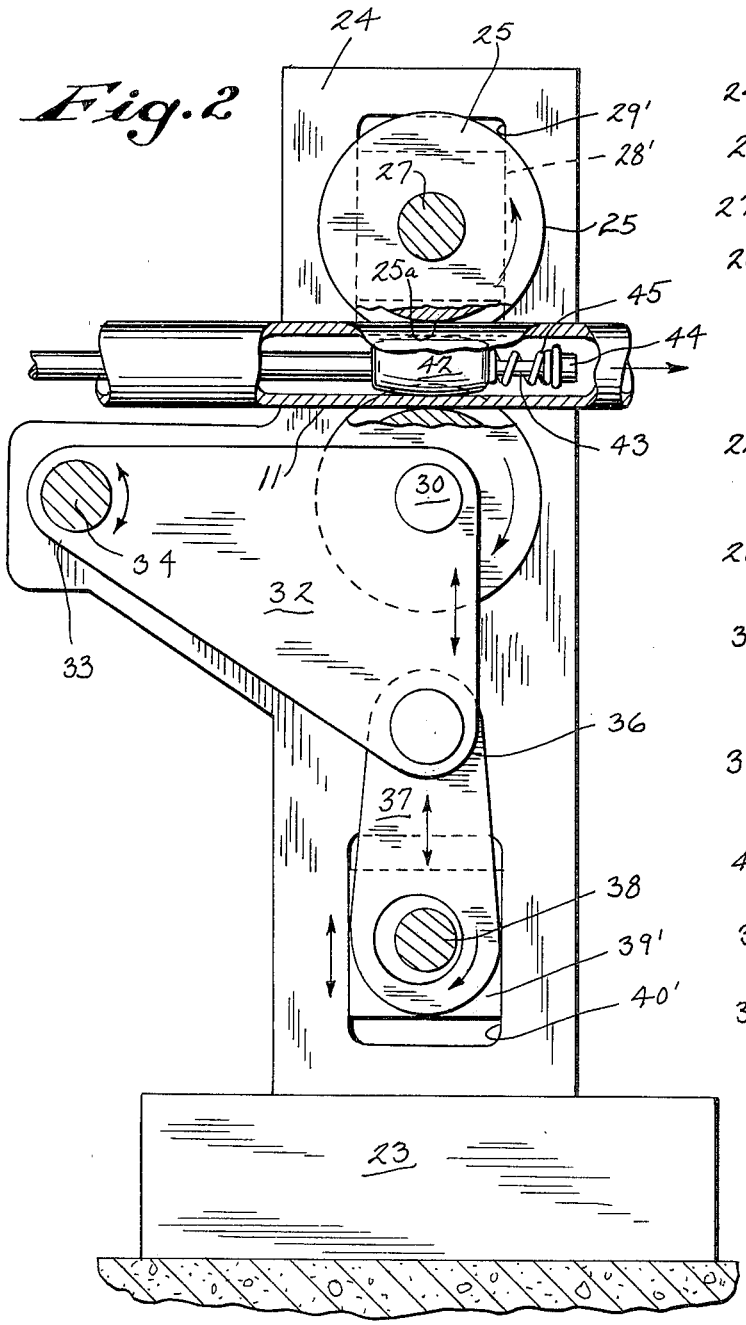
FIG. 2 is an enlarged and more detailed side elevational view, partly in section, of the bead flattening machine shown in FIG. 1.
Figure 3:
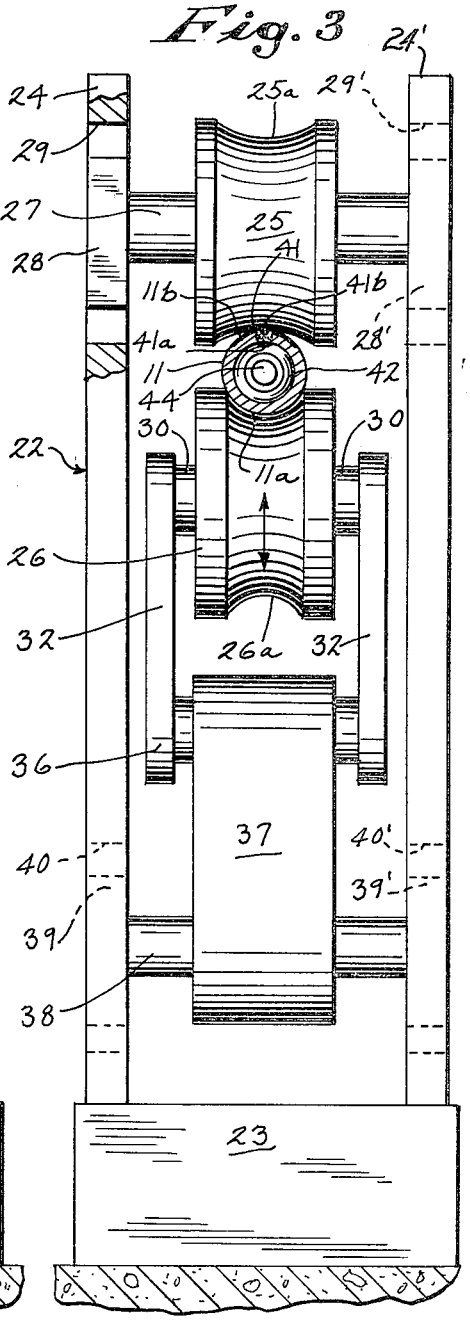
FIG. 3 is an end elevational view of the bead flattening machine of FIG. 2.

Turning now to FIGS. 2 and 3, it can be seen that the bead flattening machine or apparatus 22 includes a base 23 to which a pair of upright spaced apart support stands 24 and 24′ are attached. Operatively supported by the support stands 24 and 24′ are a pair of rollers 25 and 26. The upper roller 25, which serves as an anvil, is rotatable about a shaft 27 which is fixed on slide blocks 28, and 28′, slidably positioned within slots 29, and 29′ in the support stands 24 and 24′. The roller 25 is adjustable vertically upward and downward by moving the slide blocks 28 and 28′ within the slots 29, 29′ and it can be locked into a desired position by use of conventional locking means such as a lock screw (not shown).

Still referring to FIGS. 2 and 3, it is seen that the lower roller 26 is mounted on a shaft 30 which is connected to the corners 31, 31′ of a triangular yoke assembly 32. As seen best in FIG. 2, the triangular yoke 32 is connected at its apex 33 to a pivot pin 34 which is held between support stands 24 and 24′. The yoke 32 is attached at its free corner 36 to a connecting rod 37 which is connected at its other end to an eccentric shaft 38 which is driven by a drive means not shown. The yoke 32 is connected to the shaft 30, pivot pin 34 and the connecting rod 37. As the shaft 38 turns, the connecting rod 37, yoke 32, and roller 26 oscillate vertically in a straight line motion as opposed to a sinusoidal motion. The roller 26, yoke 32, and connecting rod 37 constitute the external hammer means and are adjustable vertically upward and downward by moving slide blocks 39, and 39′ which are attached to the eccentric shaft 38 within a slot 40, 40′ in each of the support stands 24, 24′.

As seen in FIG. 3, the rollers 25 and 26 are adjusted so that when the machine is at rest the exterior surface 11*a* of the tubing 11 opposite the weld 41 is received in the groove 26*a* of the roller 26 and the surface 11*b* adjacent the weld 41 is received in a groove 25*a* of the roller 25.

The bead flattening machine 22 of the present invention removes the internal bead 41*a* of the weld 41 by hammering upon the exterior surface 11*a* of the tubing opposite the weld 41 to force a mandrel 42 which is attached to the free end of the rod 16 and which is located within the tubing 11 into the internal bead 41*a* of the weld 41 to flatten it. The external surface 41*b* of the weld 41 is simultaneously rounded and shaped by the interior surface of the groove 25*a* of the upper roller 25. As the tubing 11 moves through the machine 22 the internal bead 41*a* of the weld 41 is removed by a series of successive blows which are struck upon the external surface 11*a* of the tubing 11 by the roller 26 which oscillates vertically upward and downward. In a preferred embodiment, the eccentric shaft 38 is driven at an appropriate speed. The precise speed at which the shaft 38 is to be driven for a given operation will depend upon the size of the bead 41*a* to be removed and the speed of the tubing 11 passing through the bead flattening apparatus 22.

Referring once again to FIG. 2, it can be seen that the mandrel 42 is mounted for axial movement upon a shaft 43 at the end of the rod 16. This is necessary because as the tubing 11 moves through the bead flattening machine 22 and it is struck by the roller 26, there is a tendency for the mandrel 42 to move along with the tubing 11. However, when the pressure of the blow is relieved the mandrel 42 must be returned to its original position to receive a successive hammering blow as in the Siegerist patent device. For this purpose, a spring 44 is interposed on the shaft 43 between an end cap 44 and the mandrel 42. The spring 45 is biased towards returning the mandrel 42 to its original operative position. The rod 16 with the mandrel 42 mounted as described is preferred; however, similar results can be obtained by using a resilient cable and mandrel in the manner shown in the Siegerist patent, or by mounting the spring on the opposite end of the rod 16 and allowing the rod 16 and the mandrel 42 to move as a single body.

The bead flattening machine of the present invention possesses several distinct advantages over the prior art machines. In contrast to the Siegerist apparatus which has a pair of hammers whose action must be coordinated, the machine of the present invention has a single hammer with a rotating roller head. Furthermore, since both the upper and lower rollers rotate about shafts, the resistance to the movement of the tubing through the machine is minimized.

The apparatus of the present invention has advantages over the Preusch apparatus in that the hammering motion is linear rather than sinusoidal, thereby becoming much more effective since the weld bead is hammered rather than rolled into shape. Furthermore, the force exerted by the vertically oscillating roller is magnified because it also includes the mass of the yoke and connecting rod. The tendency of roller 25 to "pick up" metal from weld surface 41*b* is reduced substantially, since there is constant contact (v.s. intermittent contact) of roller and tube and there is no tendency of roller 25 to overrun or go faster than tube speed as in the Preusch apparatus. Additionally the application of hammer blows to the tube side opposite the weld provides mandrel stability and minimizes the tendency of the tube to rotate about a longitudinal axis. Also, it does not require the pressure sensing means which is considered by Preusch to be essential.

It will be readily apparent to those skilled in the art that a number of changes and modifications can be made without departing from the spirit and scope of the present invention. Therefore, it is intended that the invention not be limited except by the claims which follow:

I claim:

1. An apparatus for removing by flattening the weld bead formed by the longitudinal seam welding of tubing includes:

(a) a mandrel positioned within the tubing;

(b) external hammer means positioned to forcibly strike the external surface of the tubing opposite the weld and to force the mandrel which is within the tubing against the weld to flatten it; and (c) anvil means for shaping the external surface of the weld.

2. The apparatus of claim 1 in which the external hammer means is a roller which oscillates vertically in a linear motion upward and downward to strike successive blows upon the exterior surface of the tubing opposite the weld.

3. The apparatus of claim 1 in which the anvil means for shaping the external surface of the weld is a second roller having a groove which receives the external surface of the tubing adjacent the weld.

4. An apparatus for removing by flattening the internal bead of a tubing formed by longitudinal seam welding which apparatus includes:

(a) a mandrel positioned within the tubing;

(b) a single external hammer means positioned to forcibly strike the external surface of the tubing opposite the weld and to thereby force the mandrel against the weld to flatten it; and (c) anvil means for shaping the external portion of the weld and to prevent the weld from being deformed.

5. An apparatus for removing by flattening the internal bead formed by longitudinal seam welding of tubing which includes:

(a) a mandrel resiliently positioned within the tubing;

(b) a vertically oscillating roller having a groove which receives the external surface of the tubing opposite the weld, said roller being attached to a shaft which is attached to a triangular yoke which is connected in turn to a connecting rod which is driven by an eccentric shaft to impart an oscillating vertical motion to the roller so that the roller strikes the surface of the tubing opposite the weld successive linear blows forcing the mandrel into the internal weld bead thereby flattening the bead; and (c) a second roller positioned opposite and above the first roller and being spaced therefrom, said second roller having a groove in which the exterior surface of the tubing, including the weld is received, said groove being shaped so that as the internal bead of the tubing is flattened by being struck with the anvil, the external surface of the weld and the adjacent area of the tubing is prevented from being deformed by the curved surface of the groove in the second roller which serves as an anvil.

* * * * *